US006110090A

United States Patent [19]

Ausnit

[11] Patent Number: 6,110,090

[45] Date of Patent: Aug. 29, 2000

[54] METHOD AND DEVICE FOR PROVIDING A SEALING GASKET TO CLOSURE STRIPS FOR RECLOSABLE PLASTIC BAGS

[75] Inventor: Steven Ausnit, New York, N.Y.

[73] Assignee: Illinois Tool Works Inc., Glenview, Ill.

[21] Appl. No.: 09/207,247

[22] Filed: Dec. 8, 1998

[30] Foreign Application Priority Data

Feb. 25, 1998 [FR] France ..... 98 02272

[51] Int. Cl.[7] ..... B65B 1/90

[52] U.S. Cl. ..... 493/212; 493/213; 493/214

[58] Field of Search ..... 493/212, 214, 493/213, 927; 383/63, 64, 65

[56] References Cited

U.S. PATENT DOCUMENTS

| | | | |
|---|---|---|---|
| Re. 34,554 | 3/1994 | Ausnit | 383/63 |
| 3,164,186 | 1/1965 | Weber et al. . | |
| 3,532,571 | 10/1970 | Ausnit . | |
| 3,839,128 | 10/1974 | Arai | 493/213 |
| 4,807,300 | 2/1989 | Ausnit et al. . | |
| 4,896,775 | 1/1990 | Boeckmann et al. . | |
| 4,969,967 | 11/1990 | Sorensen et al. . | |
| 5,641,318 | 6/1997 | Vetter | 493/213 |
| 5,769,772 | 6/1998 | Wiley | 493/214 |
| 5,947,603 | 9/1999 | Tilman | 383/64 |

FOREIGN PATENT DOCUMENTS

| | | |
|---|---|---|
| 90167 | 12/1960 | Denmark . |
| 94/25348 | 11/1994 | WIPO . |

*Primary Examiner*—Eugene Kim

*Attorney, Agent, or Firm*—Pitney, Hardin, Kipp & Szuch LLP

[57] ABSTRACT

A continuous method of providing a gasket to a reclosable fastener strip having reclosable closure strips with interlocking profiles. The fastener strip is moved longitudinally, the profiles are disengaged and the closure strips are separated by approximately 90° from one another. A membrane is conveyed, independently of the fastener strip, along a path that brings it parallel to one of the closure strips. Thereafter, the separated closure strips are brought back together to sandwich the membrane between their respective profiles and the profiles are re-engaged.

20 Claims, 10 Drawing Sheets

100
6
4
9
7
8
42
44
5
41
46
43

METHOD AND DEVICE FOR PROVIDING A SEALING GASKET TO CLOSURE STRIPS FOR RECLOSABLE PLASTIC BAGS

BACKGROUND OF THE INVENTION

This present invention relates to the field of plastic bags including reclosable fastener strips with complementary male and female interlocking profiles.

The introduction of a plastic membrane film between the complementary profiles of a reclosable fastener strip to form a gasket and make the fastener strip watertight is already known.

For example, in DK 90 167, the closure strip is U-shaped in cross-section to the profiles in their longitudinal direction. There are two profiles. Each profile is located on one branch of the U. One of these branches is welded to one wall of a bag so that when the branches of the U are pressed against one another, the profiles close over both walls.

U.S. Pat. No. 3,164,186 describes a bag with a funnel that includes a reclosable fastener strip. A tubular film is welded to this strip so as to cover the inside wall of the part of the funnel that is attached to the strip. When the profiles are engaged, the film forms a watertight seal between the interlocking profiles.

U.S. Pat. No. Re 34,554 also describes reclosable fastener strips with one or two membranes. These membranes are welded to the strips or co-extruded with them, and form a watertight seal between the interlocking profiles when the latter are engaged.

These references thus disclose special reclosable fastener strips but do not disclose how to make watertight conventional reclosable fastener strips whose interlocking male and female profiles are already engaged.

SUMMARY OF THE INVENTION

The object of the present invention is to provide a process and an apparatus to make watertight interlocking male or female profiles that are already engaged with one another.

More precisely, the invention discloses a process and an apparatus to form a closure with a gasket, including the following steps:

- moving a reclosable fastener strip consisting of two closure strips with engaged interlocking profiles parallel to the longitudinal direction of the closure strips; and
- conveying, independently of the closure strips, a membrane to a positioning means in the path of motion of the reclosable fastener strips;
- disengaging the profiles from one another;
- gradually spreading apart the two closure strips;
- introducing and positioning the membrane between the closure strips by use of the positioning means so that its movement downstream of the positioning means is parallel to the movement of one of the closure strips; and
- pressing the strips together until the profiles are re-engaged with one another with the membrane between them.

The invention also contemplates an apparatus for implementing this process. The apparatus includes:

- a system for moving a reclosable fastener strip, with interlocking profiles engaged with one another, parallel to the longitudinal direction of the strip;
- means for positioning a membrane between the closure strips;

- mean for separating the profiles in order to disengage the profiles from each other;
- guiding control means for gradually separating the closure strips from one another up to the positioning means; and
- means for pressing the strips against one another until the profiles are re-engaged with the membrane between them.

Advantageously, the process and apparatus according to the invention also make it possible to seal one edge of the membrane to at least one of the closure strips after the film has been introduced between the profiles.

Advantageously, the process and apparatus according to the invention are also used to introduce a membrane between two closure strips each having attached to it or integrally formed with it a sheet capable of forming one bag wall.

The membrane can be introduced between the profiles of a double profile reclosable fastener strip.

In an advantageous variant, the process according to the invention is characterized by the fact that at least one closure strip is separated from the other closure strip so as to completely clear the space at right angles to the other closure strip or strips.

The apparatus for practicing this particular embodiment of the process also includes guiding means for separating the closure strips in order to completely clear the space at right angles to the other closure strip. The maximum angle between the closure strips when separated may then be approximately 90°.

In an advantageous variant, the invention covers a method and apparatus for introducing the membrane in the form of a single, unfolded tape between the profiles.

Under another variant, the invention covers a method and apparatus for introducing between the profiles a membrane whose lateral portions are folded lengthwise onto themselves to form a double tape.

The invention also covers a reclosable fastener strip with interlocking profiles or a bag including such a reclosable fastener strip characterized in that it also includes a membrane introduced between the profiles according to the process of the invention.

Other aspects, advantages and objectives of the invention will become clear from a reading of the detailed description below.

BRIEF DESCRIPTION OF THE DRAWINGS

The invention will be more fully understood with reference to drawings in which:

FIG. 3 is a more detailed schematic side view of the unit for inserting a membrane between interlocking profiles on the bag-making apparatus of FIG. 2 and on which

FIG. 10 is a schematic representation of another variant of positioning means G; in which

FIG. 13 is a schematic cross-sectional view depicting the movement of the profiles and membranes and the means for sealing the membranes to the reclosable fastener strips in which

DETAILED DESCRIPTION OF THE PREFERRED EMBODIMENTS

Figures 1, 2:
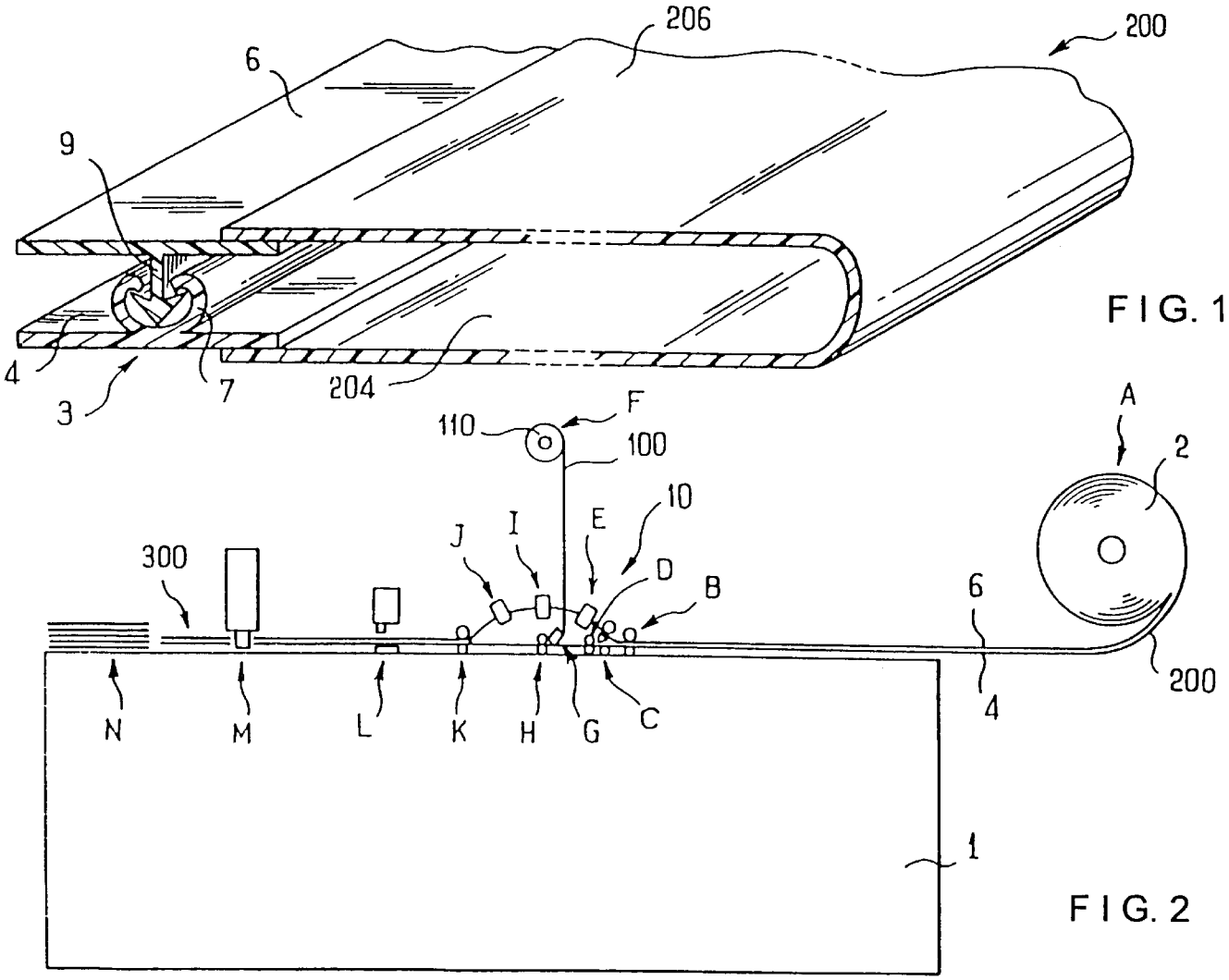
FIG. 1 is a fragmentary schematic cross-sectional perspective view of a tube consisting of a plastic film and having a reclosable fastener strip for use in making bags on the apparatus and using the process in accordance with the invention.
FIG. 2 is a schematic longitudinal cross-section showing an apparatus for forming bags and equipped with a unit for introducing a membrane between interlocking profiles in accordance with the present invention.

According to a preferred embodiment, the process according to the invention is used for forming bags 300 including a membrane 100 to form a gasket for the reclosable fastener strip of the bag. For that purpose, a tube 200, equipped with a single recloseable fastener 3, is fed through a bag forming machine 1 equipped with a gasket adding device in accordance with the present invention.

Details of the tube 200 are shown in FIG. 1. The tube includes a film folded back onto itself to form a lower sheet 204 and an upper sheet 206. Each of these sheets, 204 and 206, serves to form a wall of the final bag 300 formed on the machine and includes a lower 4 and upper 6 closure strip, respectively. Each closure strip 4, 6 is sealed or co-extruded on the free longitudinal edge of its respective sheet 204, 206. The lower strip 4 includes a female profile 7 in the form of a groove. The upper strip 6 includes a male profile 9 that can become interlocked with the female profile 7. Profiles 7 and 9 may be in any form known to those skilled in the field. There may also be a number of profiles 7, 9 on each closure strip 4, 6.

FIG. 2 shows a machine 1 for forming bags and includes a unit 10 for inserting a membrane 100 between profiles 7 and 9. The various means of forming bags and introducing the membrane 100 are designated by letters A through N along the length of the machine. Thus, tube 200 is unwound from a reel A. The unwound tube 200 is then conveyed toward the assembly 10 for inserting the membrane 100 between the profiles of the reclosable fastener strip on the tube. The unit 10 for inserting the membrane 100 includes guides B, C, D, E, H, I, J, K which guide the closure strips of the reclosable fastener strip, means for positioning the membrane G and sealing means L.

The membrane 100 is unwound from a reel 110 by appropriate unrolling means at F. Reference is now made to FIG. 3 which is a more detailed representation of the membrane insertion device 10. The device 10 consists of a number of grooved and aligned rollers 14, 16, 18. It also includes grooved rollers 20, 22, 24 to guide the upper closure strip 6 which includes the male profile 9, and designed to clear a space at right angles to strip 4 which includes the female profile 7. In order not to overload FIG. 3, the male 9 and female 7 profiles are not shown. Flat-surfaced rollers 11, 13, 15, 17, 19, 21, 23, 25, 27 keep the lower closure strip 4 and/or the upper closure strip 6 in position against the grooved rollers 12, 14, 16, 18, 20, 22, 24 (the flat-surfaced rollers 23 cannot be shown on this figure as it is behind grooved roller 22).

Figure 3A:
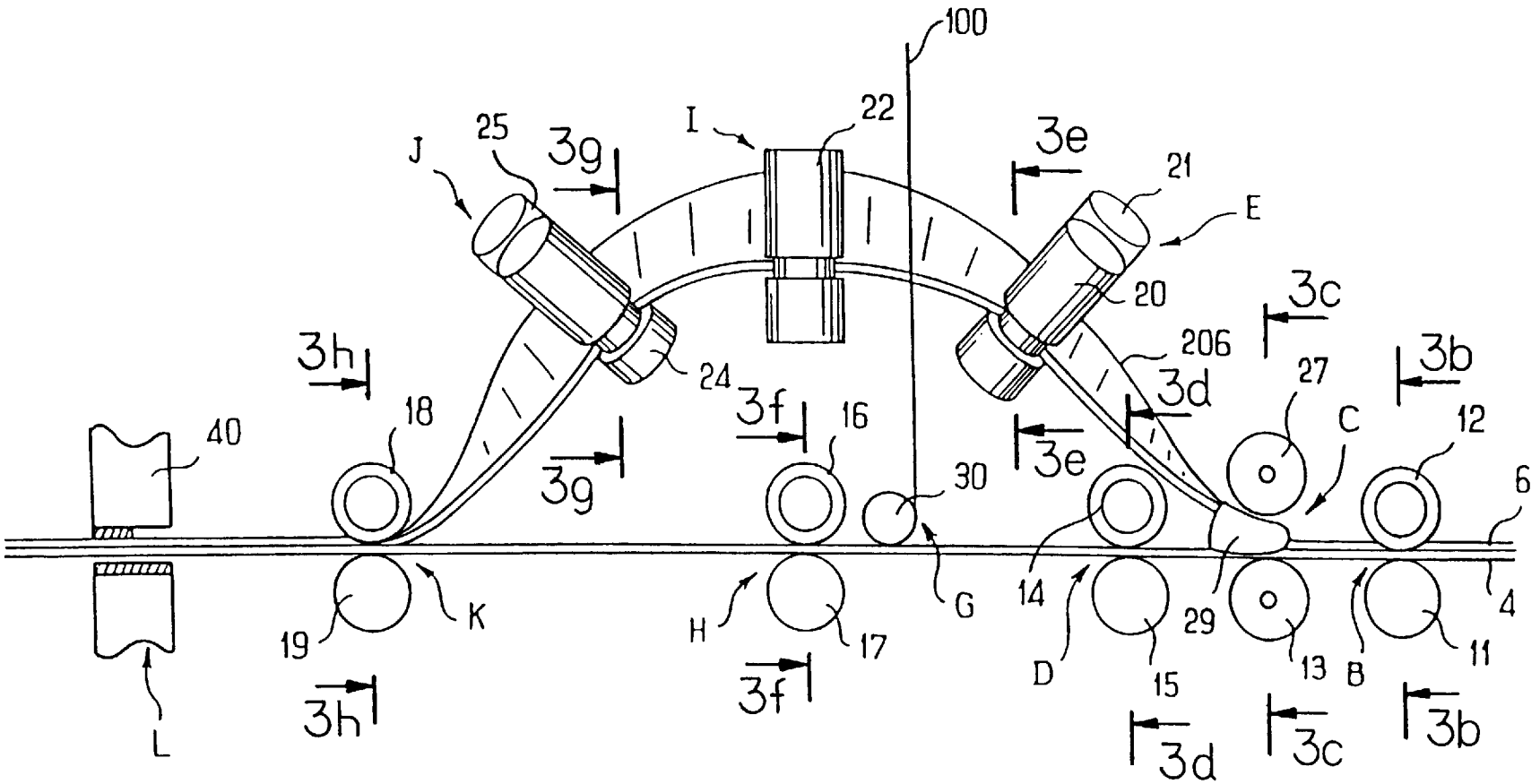
FIG. 3*a* is a longitudinal view, lateral with respect to the movement of the profiles
Figure 3B:
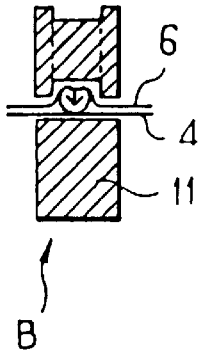
FIGS. 3*b*, 3*c*, 3*d*, 3*e*, 3*f*, 3*g* and 3*h* are schematic sectional views taken off FIG. 3*a* of the means B through K for controlling the positioning of the profiles.
Figure 3C:
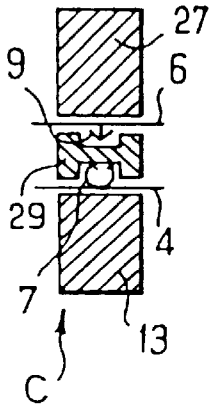
Figure 3D:
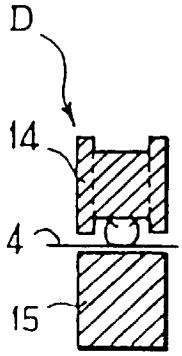

Tube 200 with closure strips 4 and 6 passes between the first guide means B (FIGS. 3*a* and 3*b*), then is conveyed toward means C for separating the profiles (FIGS. 3*a* and 3*c*). At the separation means C, closure strips 4 and 6 are separated by a separator device 29 and guided by flat-surfaced rollers 13 and 27. The separator device 29 includes two grooves. These grooves are radially opposed and the respective bottoms of the grooves converge toward one another in the direction opposite the direction of movement of profiles 7, 9. A female 7 or male 9 profile is positioned in each of the grooves.

Figure 3E:
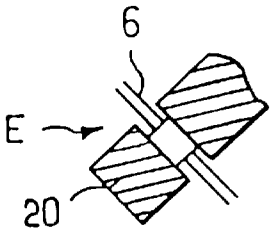
Figure 3G:
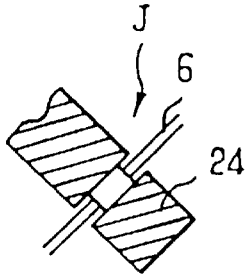
Figure 3F:
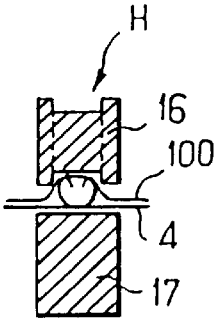
Figure 3H:
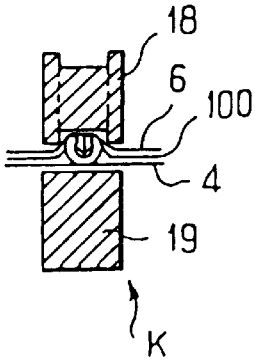
Figure 4:
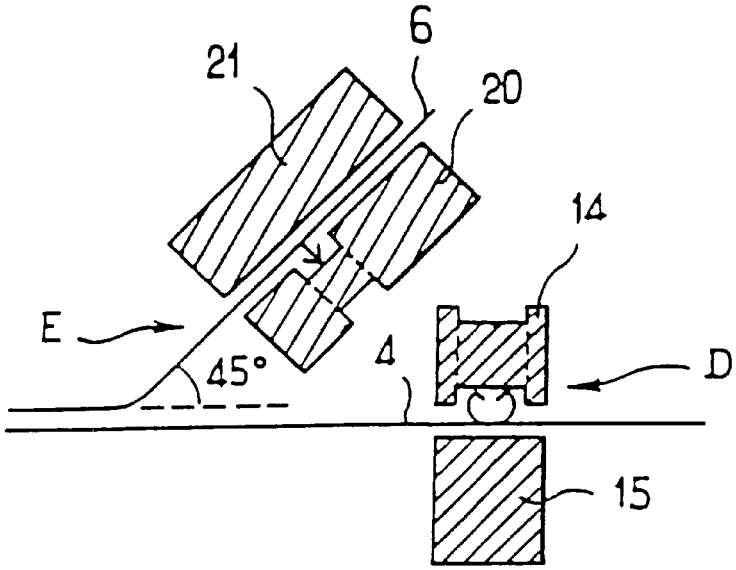
FIG. 4 is a schematic cross-sectional view of the profile guide means D and E;.

While closure strip 4 and the lower sheet 204 are guided in a straight line by the guide means D, the closure strip 6 and the upper sheet 206 are conveyed to the third guide means E. The guide means D consist of a grooved roller 14 and a flat-surfaced roller 15, both of them similar to the grooved roller and flat-surfaced roller of the first guide means B. The third guide means E consist of a grooved roller 20 and a flat-surfaced roller 21. As shown in FIG. 3*a*, the combined rollers 20 and 21 are tilted both with respect to the longitudinal plane and with respect to the transversal plane of unit 10 (FIG. 3*a*, FIG. 3*e* and FIG. 4). The angle of inclination of these wheels with respect to each of these planes is, for example, 45°.

The membrane 100 arrives at the bag making machine vertically and crosswise with respect to the direction of unwinding of the tube 200. The membrane 100 is guided and positioned on the lower strip 4 by positioning means G. In this embodiment of the invention, the positioning means G consists of a positioning roller 30. Roller 30 is a rotating cylinder whose axis of rotation is parallel to the plane of the closure strip 4 and perpendicular to the movement of the lower closure strip 4. The surface that generates the external rotation of the cylinder brushes against profile 7 of strip 4. Positioning means G can also be provided by an inclined and/or curved blade presenting a convex surface in contact with the membrane 100. Other geometries can also be envisaged for positioning means G.

Figure 5:
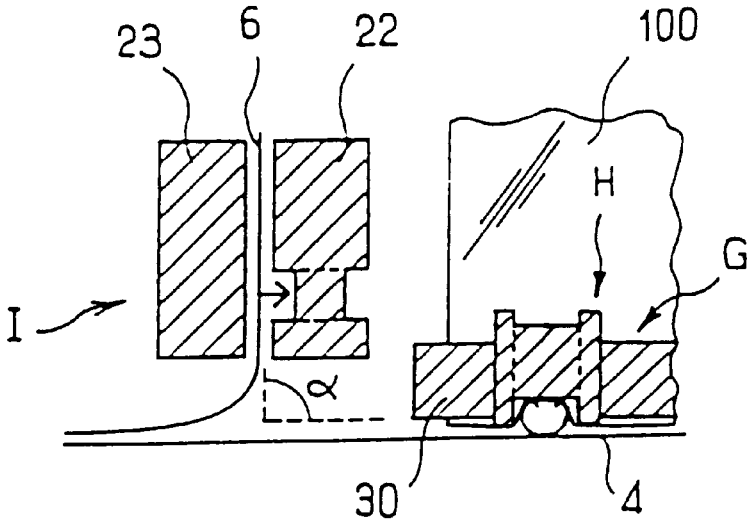
FIG. 5 is a schematic cross-sectional view of the profile guide means H and J, as well as membrane positioning means G.

The membrane 100 and the lower closure strip 4 are conveyed toward the fourth guide means H. The fourth guide means H consist of a grooved roller 16 and a flat-surfaced roller 17 which are similar to the first guide means B and the second guide means D. As shown on FIG. 3*f*, guide means H make it possible to apply the membrane 100 onto the closure strip 4. At this point of forward movement of the tube 200, the upper closure strip 6 and the upper sheet 206 are kept at their free end in a vertical position and reach the level of the fifth guide means I (FIG. 3*a*, FIG. 5). The planes of lower 4 and upper 6 strips then form an angle $\alpha$ between them, which is equal to a maximum of approximately 90°. Thus, the upper closure strip 6 is separated from the lower closure strip so as to completely free up the necessary space for positioning the membrane 100 on the lower strip 4.

Figure 6:
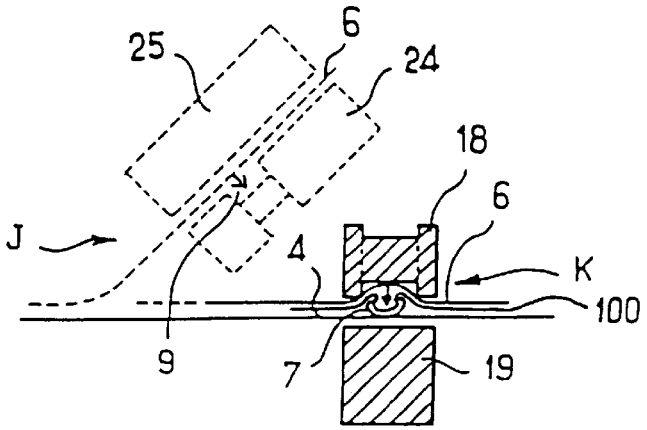
FIG. 6 is a schematic cross-sectional view of guide means J and K.

After the membrane 100 is positioned on the lower closure strip 4, the upper closure strip 6 and sheet 206 are gradually moved back into position on the lower strip 4 and the lower sheet 204. This is done with sixth guide means J, consisting of a grooved roller 24 and a flat-surfaced roller 25, which are similar to the third guide means E. The male profile 9 is then re-engaged in the female profile 7 at the location of the guide means K (FIG. 6: on this figure, guide means J are shown by dotted lines to indicate that they are not in the same plane as guide means K). The guide means K are made of a small grooved roller 18 and a small flat-surfaced roller 19, both similar to the rollers of the first, third and fourth guide means B, D, H already described. At guide means K the membrane 100 is inserted between the male 7 and female 9 profiles of the lower 4 and upper 6 closure strips.

Figure 7A:
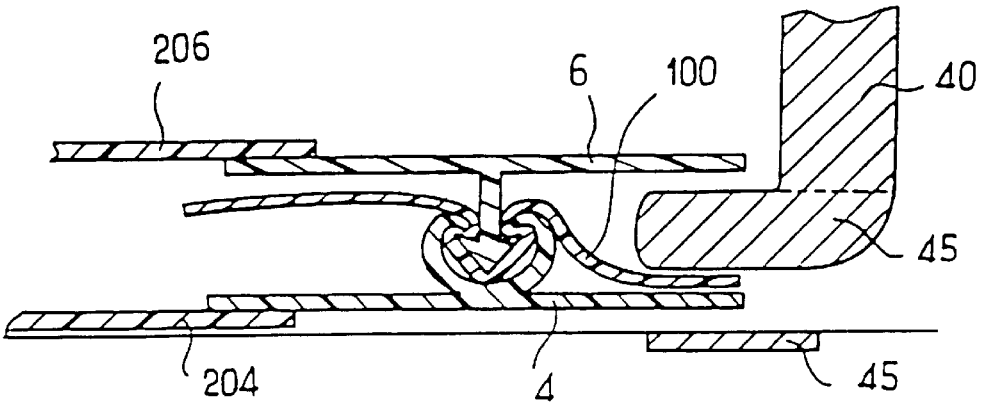
FIGS. 7*a* and 7*b* are schematic cross-sectional views of sealing means L.

The entire assembly of the lower closure strip 4, upper closure strip 6, the lower sheet 204 and upper sheet 206, which also rest on one another, is then conveyed toward sealing means L. Sealing means L consist, for example, of a pressure bar 40 and heating means 45, the pressure bar 40 applying the heating means 45 on to the membrane 100 to seal the membrane 100 to the lower closure strip 4 (FIG. 7*a*).

Figure 7B:
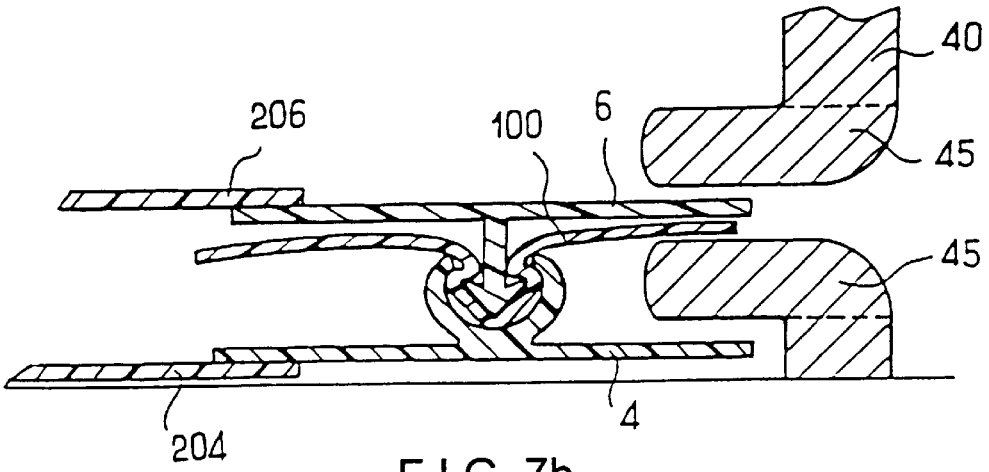

According to one variant, the membrane 100 is sealed to the upper closure strip 6, by the pressure bar 40, and heating means 45 that press and heat the membrane 100 and the upper closure strip 6 together (FIG. 7*b*). Other sealing means L will be described below.

The tube 200 are then be conveyed toward cutting means M to be transformed in a conventional manner into bags 300. The bags 300 are them stacked at a stacking station N.

Figure 8:
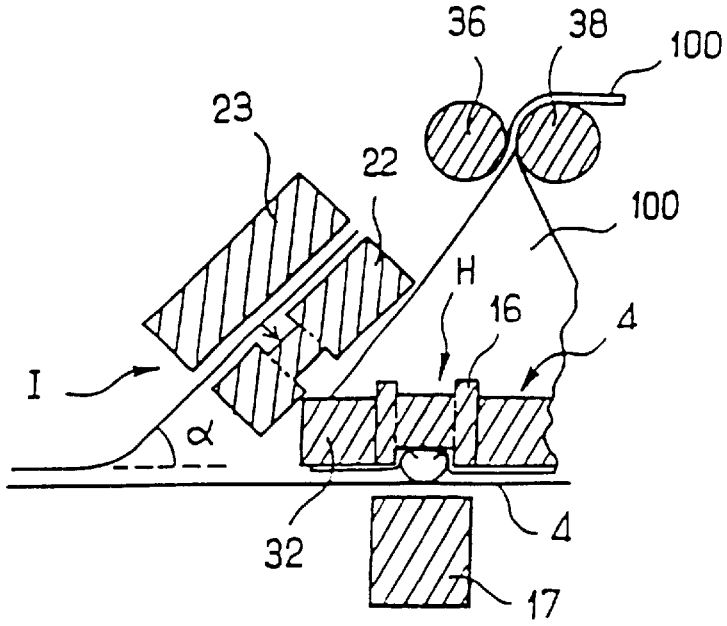
FIG. 8 is a schematic cross-sectional view of a variant of the guide and positioning means shown in FIG. 5.
Figure 9:
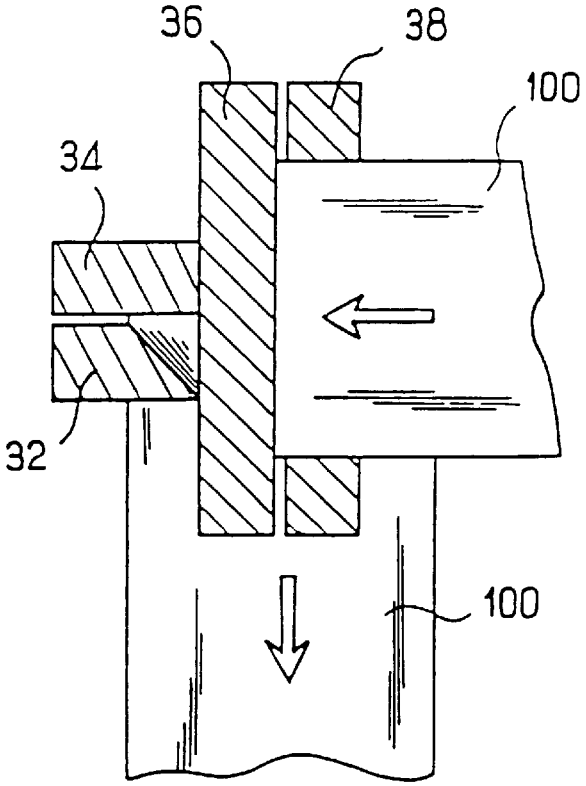
FIG. 9 is schematic top view of positioning means G of a variant shown in FIG. 6.

Numerous variants of the process and of the apparatus described above, can be envisaged while continuing to be in accordance with the invention. Thus, positioning means G can consist of positioning rollers 32, 34, 36, 38 (FIGS. 8 and 9). These rollers 32, 34, 36, 38 are similar in form to that of rollers 30 already described. As shown on FIGS. 8 and 9, rollers 36, 38 are oriented with their axis of revolution parallel to the movement of the lower strip 4. A slight space is reserved between these rollers 36, 38 to guide the membrane 100 to arrive crosswise with respect to the movement of strip 4. Below rollers 36, 38, the membrane 100 is twisted 90° so as to extend over its entire width between rollers 32, 34. The axis of rollers 32, 34 is in a plane parallel to that of closure strip 4 and perpendicular to the direction of movement of closure strip 4. As illustrated in FIG. 8, according to this form of embodiment of the apparatus according to the invention, the space to be reserved at right angles to the closure strip 4 to bring the membrane 100 in contact with the closure strip, is smaller than the space shown in FIG. 5. Thus, guide means I can be inclined, for example, at a 45° angle above the lower closure strip 4. This makes it possible to reduce the torsion imposed on the upper closure strip 6, and to reduce the dimensions of the overall machine 10.

Figure 10B:
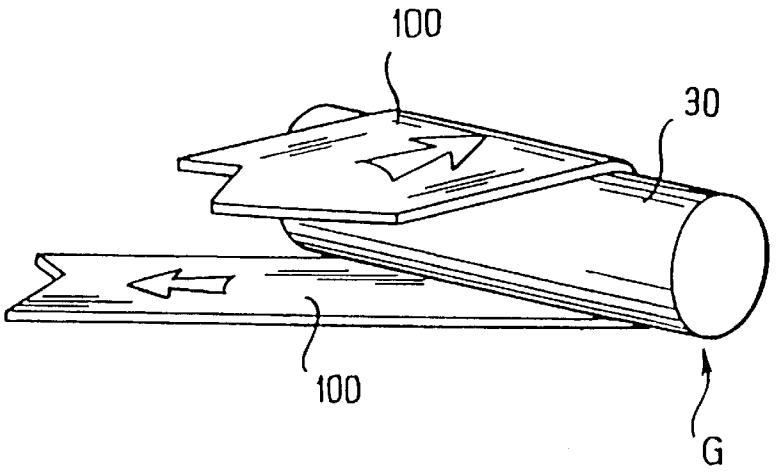
FIG. 10*a* is a top view and figure 10*b* is a side perspective view.
Figure 10A:
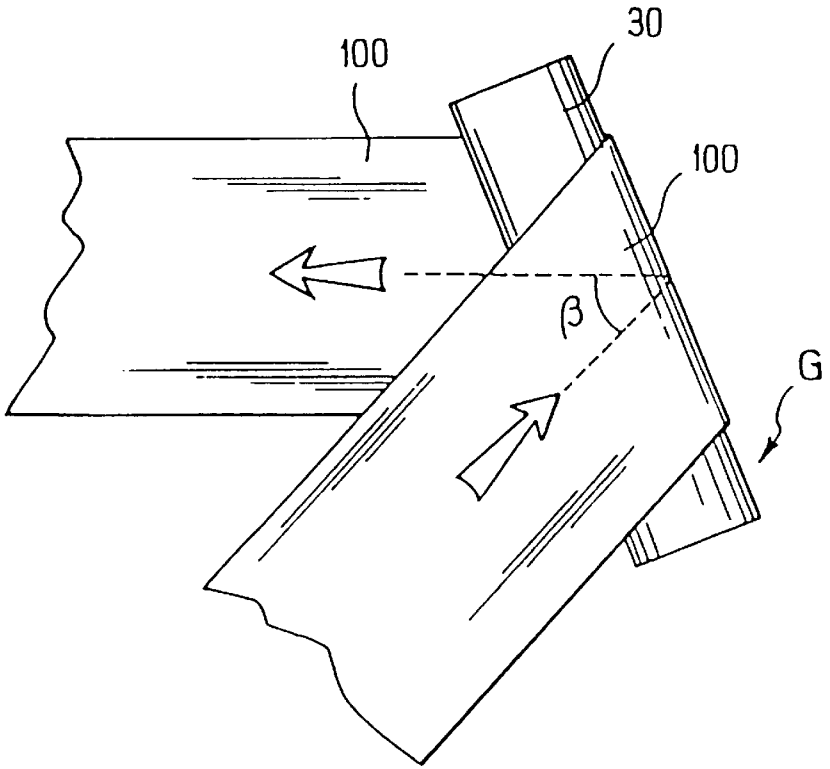

As shown on FIG. 10, in another variant of the apparatus 10 according to the invention, positioning means G include at least one roller 30. FIG. 10*a* shows a membrane 100 folded in a U shape around the roller 30. The planes of the portions of the membrane 100 before and after the roller 30 are parallel to the plane of the lower closure strip 4. The direction of arrival of the membrane 100 on roller 30 and the departing direction form an angle β which can be more or less open. This configuration can permit further reduction of the angle between lower 4 and upper 6 strips.

The form of embodiment of the process has been described above for the purpose of introducing a sealing membrane 100 between two closure strips 4, 6 of a single recloseable fastener 3 linked to sheets 204, 206 that are capable of forming the walls of a bag 300.

Figure 11:
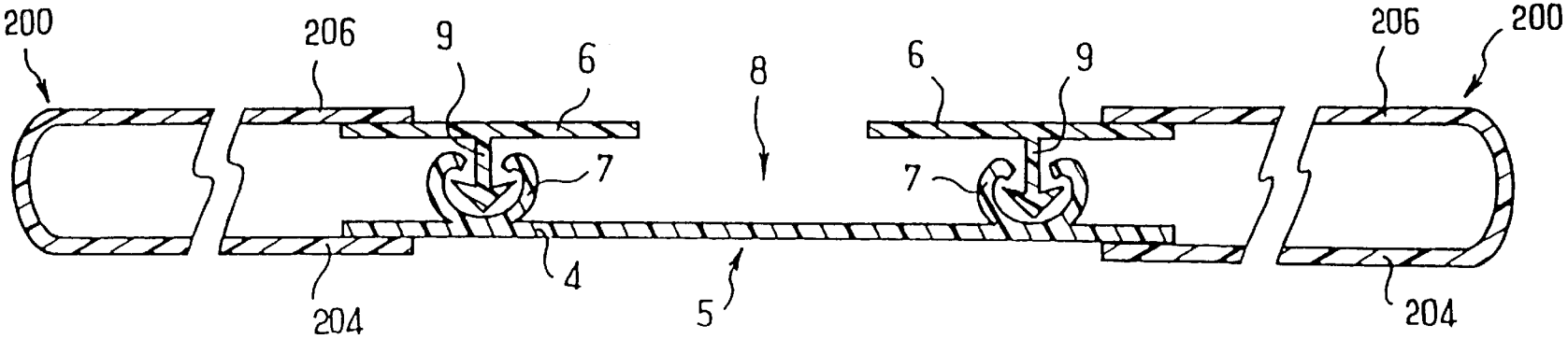
FIG. 11 is a schematic cross-sectional view with respect to the longitudinal dimension of a tube that includes a double closing device on which the process according to the invention can be implemented.

The process for forming a closure strip with a membrane described above can be used both for tubes 200 with single recloseable fastener 3 and for tubes 200 with double recloseable fasteners 5 as shown on FIG. 11. The reclosable fastener strip of FIG. 11 includes a lower closure strip 4, and two upper closure strips 6. The lower strip 4 has two female profiles 7. The two female profiles 7 are at spaced intervals from one another over the width of the closure strip 4. The upper strips 6 each have a male profile 9. The two upper strips 6 are separated from one another by a space 8 extending longitudinally with respect to the profiles 9. The lateral portions of the strips 4 and 6, located on the other side of the profiles with respect to the space 8, are linked respectively to lower and upper sheets 204 and 206 that are capable of forming the walls of a bag 300. This double recloseable fastener 5 is symmetrical with respect to the center of space 8. Sheets 204 and 206 can form either one sheet folded over onto itself, parallel to its longitudinal direction to form a U-shaped cross-section profile as indicated in FIG. 11, or, if separated they can be sealed to one another at their distal edges. In both instances, two symmetrical tubes are formed with respect to the space 8.

Alternatively, another process according to the invention also makes it possible to introduce a membrane 100 between two strips 4, 6 and to seal the membrane 100 to the closure strips, which will only be sealed later to a bag 300 or a sheet capable of forming such a bag 300.

Figure 12:
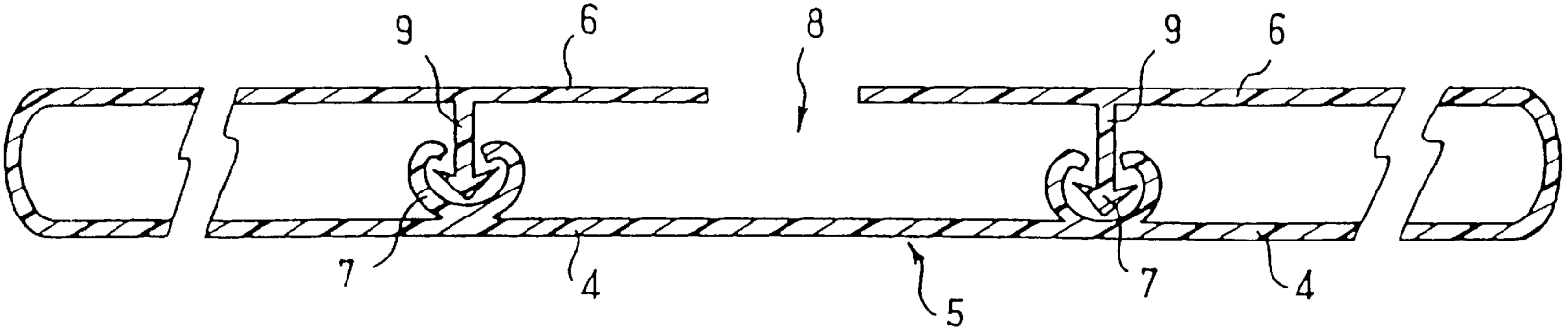
FIG. 12 is a schematic cross-sectional view of a double recloseable fastener on which the process according to the invention can be implemented.

FIG. 12 illustrates an example of strips 4, 6 that are not as yet attached to sheets 204, 206 capable of forming a bag 300. These strips 4, 6 constitute a double recloseable fastener 5 that differs from the one shown on FIG. 11 in that the lateral parts of the strips 4 and 6, located on either side of the profiles with respect to the space 8, rejoin to form a U-shaped profile in cross-section. Each of the two sets of strips 4, 6 located on either side of the space 8 can be welded at a later time to the walls of bags 300 in a manner familiar those skilled in the art.

Figures 13A, 13B, 13C, 13D:
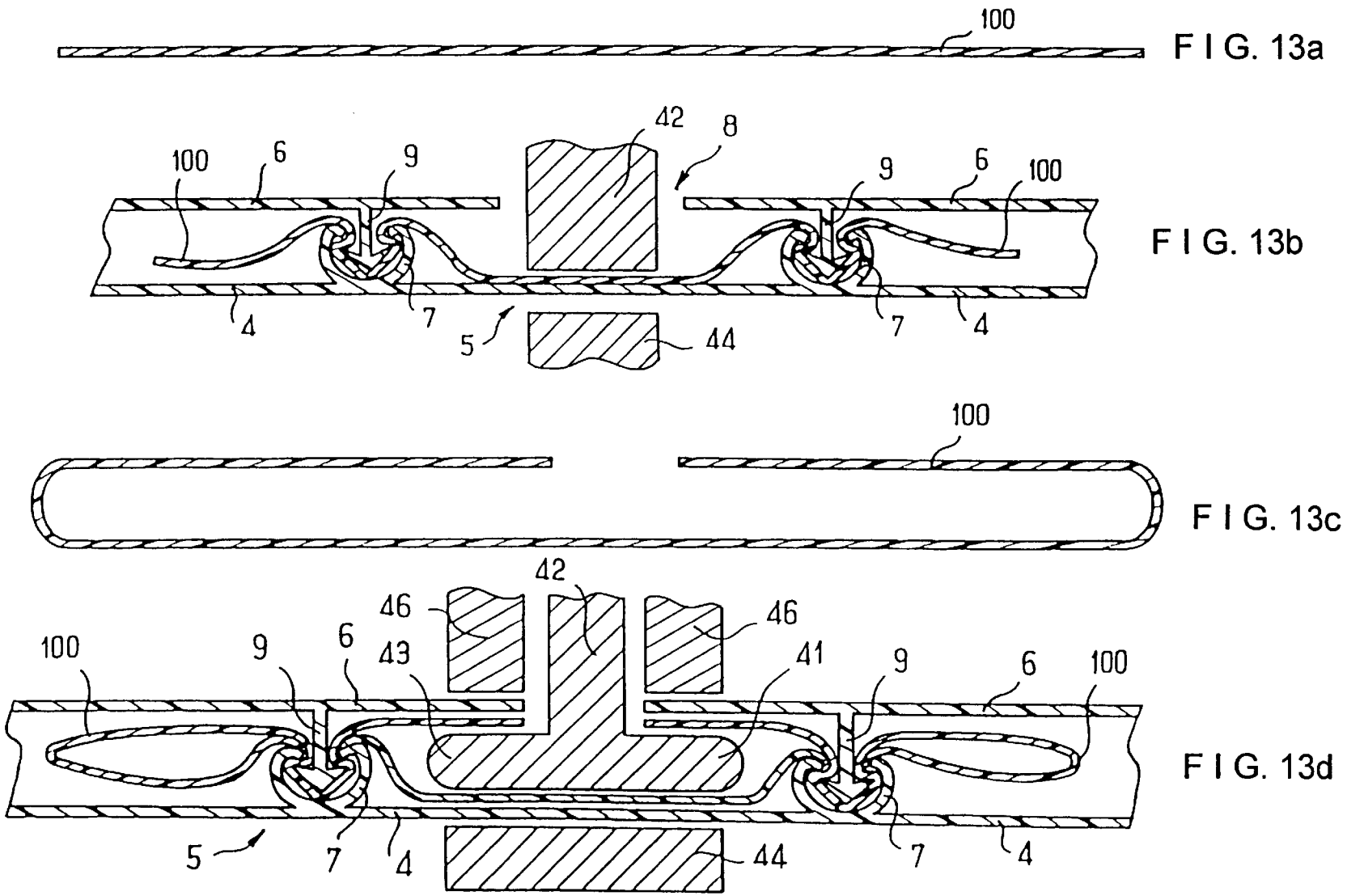
FIG. 13*a* shows a single membrane.
FIG. 13*b* shows the sealing of the single membrane shown in FIG. 13*a*.
FIG. 13*c* shows a looped, double membrane.
FIG. 13*d* shows the sealing of the double membrane.

FIG. 13 is a schematic illustration of how to seal either a single or double membrane 100 on to a double recloseable fastener. FIGS. 13*b* and 13*d* are cross sectional views at the level of sealing means L. Single and double membranes are shown in cross-section on FIGS. 13*a* and 13*c*, respectively. The double membrane 100 on FIG. 13*c* is formed by longitudinally folding over its lateral portions, while preserving a space between its free longitudinal edges of its median zone.

Once introduced between the profiles 7, 9 of strips 4, 6, the membrane 100 is sealed by its longitudinal median zone only to the lower strip 4. When the membrane is doubled over, the membrane 100 is sealed by its longitudinal median zone to the lower strip 4 and by its two folded lateral portions to the upper strip 6.

The sealing operation is performed by a sealing bar 42 which presses the membrane 100 at the location of space 8 to the upper face of the lower strip 4 against an anvil 44. The sealing bar 42 has a back and forth movement perpendicular to the plane of movement in which the lower strip 4 moves. The sealing bar 42 includes a flat sealing surface parallel to the plane of the lower strip 4. This flat surface is perpendicular to the direction of application of the pressure necessary for sealing and presses the membrane 100 and the lower strip 4 against the anvil 44.

In order to seal a doubled over membrane 100, the sealing bar 42 includes two shoulders 41, 43. The shoulders 41, 43 extend at right angles on either side of the end of sealing bar 42, and include the flat sealing surface parallel to the plane of the lower strip 4. These shoulders 41, 43 run along the entire length of the sealing bar 42 in a direction parallel to the movement of the lower strip 4. Other sealing bars 46 flank the bar 42. They have a flat sealing surface perpendicular to the direction of application of the sealing pressure through the bar 42. These other sealing bars 46 make it possible to seal the free longitudinal edges of the membrane 100 on to the lower face of the upper strip 6, pressing them together on the shoulders 41, 43.

A single membrane 100 presents the following advantages: it furnishes a sealing gasket over the entire length of the profiles 7, 9; if it is made of very meltable material (EVA, for example), it encapsulates the welded ends of the profiles 7, 9 and makes them also watertight.

A doubled over membrane 100 makes it possible to provide a tamper evident feature. Also, if it is long enough, when product contained in a bag 300 is poured out, it can be turned inside out to protect the profiles 7, 9 and possibly also to form a pouring spout or funnel.

Figure 14:
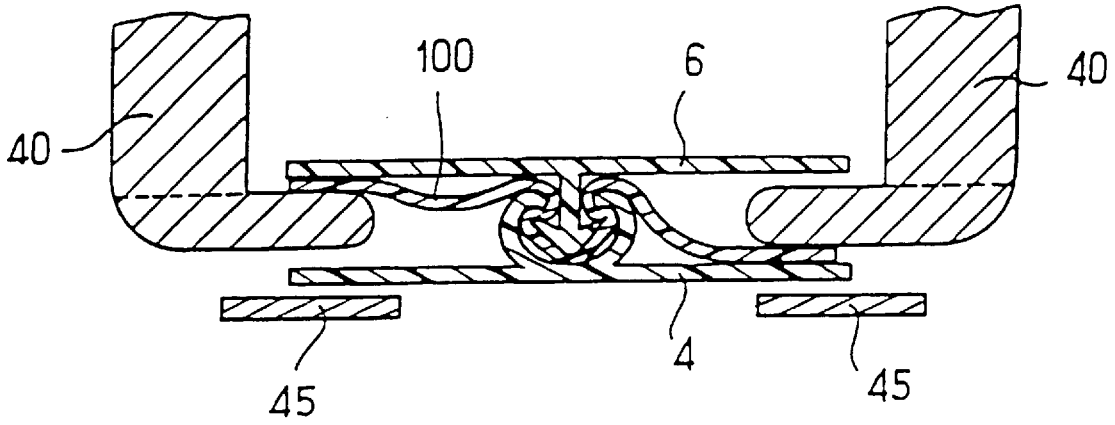
FIG. 14 is a schematic cross-sectional view of a variant of welding means L.

Another way of providing a tamper evident feature is to seal each of the free longitudinal edges of a membrane 100 to different edges of strip 4, 6. FIG. 14 illustrates sealing means L compatible with this form of embodiment of the invention. The apparatus for forming watertight closures according to the invention can also include a pair of sealing means similar to those described above and illustrated in FIG. 7. Sealing bars 42 and 46 described above may advantageously be replaced by small sealing wheels when continuous sealing of the membrane 100 to a recloseable fastener 3, 5 is desired.

Having thus described the invention, what is claimed is:

1. A process for the continuous forming of a bag closure with a gasket comprising the steps of:

(a) moving two closure strips with engaged interlocking profiles in a longitudinal direction of the engaged strips;

(b) disengaging the profiles from one another;

(c) at a point along the path of the closure strips, beginning to separate the two closure strips;

(d) conveying a membrane independently of the closure strips, between said profiles at a position along the path of the closure strips downstream of said point and then along a path substantially parallel to one of the separated closure strips;

(e) bringing the separated strips together and re-engaging the disengaged profiles with the membrane between the profiles.

2. The process in accordance with claim 1 wherein the closure strips are separated by moving one of the strips substantially 90° with respect to the other strip.

3. The process in accordance with claim 1 wherein said closure strips are no greater than 90° apart at the position at which the membrane is conveyed to said closure strips.

4. The process in accordance with claim 1 comprising the further step of affixing a lateral edge of said membrane to one of said closure strips after the membrane is introduced between the profiles.

5. The process in accordance with claim 1 wherein said closure strips each contain double sets of profiles and further comprising the steps of affixing a median longitudinal portion of said membrane between the sets of double profiles on one of said closure strips.

6. The process in accordance with claim 1 further comprising the steps of folding the lateral edges of said membrane onto a median longitudinal portion thereof, affixing said membrane median longitudinal portion to one of said closure strips between the double profiles sets and affixing said lateral edges to the other of said closure strips.

7. The process in accordance with claim 1 wherein said membrane is conveyed along a path substantially perpendicular to the longitudinal path of movement of said engaged closure strips.

8. The process in accordance with claim 1 comprising the further step of sealing one lateral edge of said membrane to one of said closure strips and sealing the other lateral edge of said membrane to the other of said closure strips.

9. A process for the continuous forming of a closure with a gasket comprising the steps of:

(a) moving two closure strips with engaged interlocking profiles in a longitudinal direction of the engaged strips;

(b) disengaging the profiles from one another;

(c) at a point along the path of the closure strips, beginning to separate the two closure strips;

(d) conveying a membrane independently of the closure strips, between said profiles at a position along the path of the closure strips downstream of said point and then along a path substantially parallel to one of the separated closure strips;

(e) bringing the separated strips together and re-engaging the disengaged profiles with the membrane between the profiles.

10. The process in accordance with claim 9 comprising the further step of affixing a lateral edge of said membrane to one of said closure strips after the membrane is introduced between the profiles.

11. The process in accordance with claim 9 wherein said closure strips each contain doublesets of profiles and further comprising the steps of affixing a median longitudinal portion of said membrane between the sets of double profiles on one of said closure strips.

12. The process in accordance with claim 9 further comprising the steps of folding the lateral edges of said membrane onto a median longitudinal portion thereof, affixing said membrane median longitudinal portion to one of said closure strips between the double profiles and affixing said lateral edges to the other of said closure strips.

13. The process in accordance with claim 9 wherein said membrane is conveyed along a path substantially perpendicular to the longitudinal path of movement of said engaged closure strips.

14. The process in accordance with claim 9 comprising the further step of sealing one lateral edge of said membrane to one of said closure strips and sealing the other lateral edge of said membrane to the other of said closure strips.

15. An apparatus for introducing a membrane between the interlocking profiles of a pair of complementary closure strips comprising:

means for longitudinally moving said closure strips;

means for disengaging said profiles;

means for separating said closure strips from one another;

means for introducing said membrane between the profiles of said separated closure strips; and means for re-engaging said profiles with said separating film captured between said profiles.

16. The apparatus in accordance with claim 15 wherein said separating means moves one of said closure strips to uncover the other of said closure strips.

17. The device in accordance with claim 16 wherein said separating means moves said one of said closure strips substantially 90° with respect to the other of said closure strips.

18. The apparatus in accordance with claim 15 wherein said separating means comprises a series of spaced apart guide rollers.

19. The apparatus in accordance with claim 15 further comprising means for sealing said membrane to one of said closure strips.

20. The apparatus in accordance with claim 19 further comprising means for also sealing said membrane to the other of said closure strips.

* * * * *